United States Patent [19]

Brouwer

[11] Patent Number: 4,531,469

[45] Date of Patent: Jul. 30, 1985

[54] VESSEL COMPRISING TWO PIVOTABLY CONNECTED HULL SECTIONS

[75] Inventor: Cornelis A. Brouwer, Oudewater, Netherlands

[73] Assignee: IHC Holland N.V., Papendrecht, Netherlands

[21] Appl. No.: 559,274

[22] Filed: Dec. 8, 1983

[30] Foreign Application Priority Data

Dec. 8, 1982 [NL] Netherlands ..... 8204747

[51] Int. Cl.[3] ..... B63B 35/30

[52] U.S. Cl. ..... 114/29

[58] Field of Search ..... 114/26, 27, 28, 29, 114/30, 56, 57, 61, 123

[56] References Cited

U.S. PATENT DOCUMENTS

| | | | |
|---|---|---|---|
| 3,509,841 | 5/1970 | DeBoer | 114/29 |
| 3,538,875 | 11/1970 | de Koning | 114/29 |
| 3,688,722 | 9/1972 | van der Werff | 114/29 |
| 3,946,686 | 3/1976 | van der Werff | 114/29 |

FOREIGN PATENT DOCUMENTS 7304384 3/1973 Netherlands .

*Primary Examiner*—Trygve M. Blix
*Assistant Examiner*—Thomas J. Brahan
*Attorney, Agent, or Firm*—Young & Thompson

[57] ABSTRACT

Vessel comprising two hull sections, pivotably connected together by hinges positioned above the center of the vessel and above the center of gravity of the separate hull sections. The vessel comprises a propulsion installation with one single propeller. The propeller shaft direction is parallel to the center line of the vessel within the central dividing plane of the vessel. Those parts of the hull sections determining the hold are joined through edges determined by the central dividing plane. Near the parts of both hull sections into or onto which the propulsion installation is positioned the hull sections are adjoined on a plane positioned at a distance from the central dividing plane such that the transverse cross sections of both hull sections are unequal. The propulsion installation is housed in the larger section.

6 Claims, 1 Drawing Figure

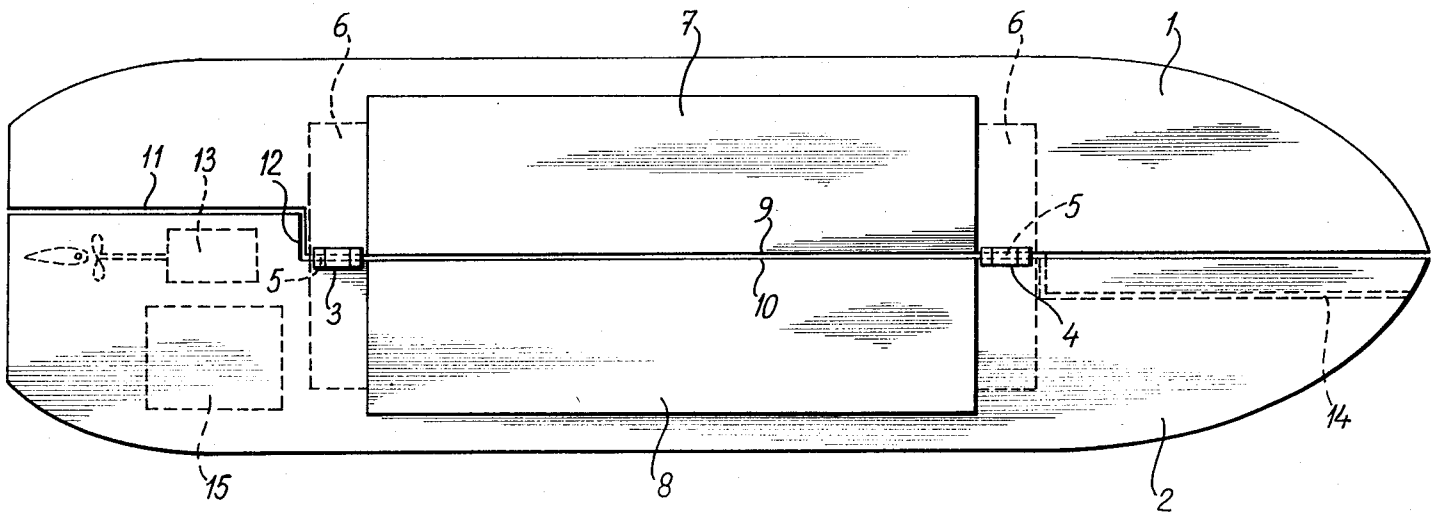
1
2
3
4
5
6
7
8
9
10
11
12
13
14
15

VESSEL COMPRISING TWO PIVOTABLY CONNECTED HULL SECTIONS

The invention relates to a vessel comprising two hull sections, pivotably connected together by means of hinges positioned above the center of said vessel and above the center of gravity of the separate hull sections, and of which the propeller shaft direction is parallel to the center line of said vessel within the vertical central dividing plane of the vessel, those parts of the hull sections of said vessel determining the hold being adjoined through edges determined by said central dividing plane, said vessel comprising a propulsion installation with one single propeller, which propulsion installation is housed in one of the hull sections.

Such a vessel, more generally indicated by the term "split vessel" is known for instance from the Dutch Pat. No. 73,04384, which is laid open to public inspection and which indicates that it is usual to house the propulsion installation in one of the two sections, in case the vessel is propelled by one single propeller. This has however the serious disadvantage, that by housing the propulsion installation in one of the two hull sections, each defining a half of the hull, the symmetry in relation to the propulsion and the balance in a transverse direction are disturbed.

It is therefore known to use separate propulsion installations in each of both hull sections of a split ship of this type, or, as is proposed in the above mentioned Dutch Pat. No. 73,04384 to use a third hull section between both pivotably connected hull sections and connected to said both hull sections, such that this third hull section is maintained in the normal position during opening and closing of the split ship.

The above mentioned known solutions are very expensive. In both cases extensive additional facilities are necessary because the propulsion installation has to be doubled and the control systems have to take into account that both halves can carry out a mutually pivotal movement, whereas in case a third hull section is used, the coupling with the two main hull sections of the vessel should be such that said third section, in which the propulsion installation is housed, is maintained in the correct position.

The object of the invention is accordingly the provide a split ship with one single propulsion installation and a very simple construction. In agreement with this object the invention provides a vessel of the above mentioned type in which near the parts of both hull sections in or on which the propulsion installation is positioned, said hull sections are interconnected in a plane positioned at a distance from said central dividing plane such that the transverse cross sections of the hull sections are unequal and the propulsion installation is housed in the larger section. According to the invention the rear body of the split ship in which the propulsion installation is positioned is constructed asymmetrically. This offers the possibility to position the propulsion installation with the propeller in the vertical central dividing plane of the vessel, but also in case it is desired for the correct distribution of weight, alongside this plane. This can be necessary because in that case the automatic opening and closing procedure of the vessel is not disturbed notwithstanding the asymmetry of the rear body. It is usual to displace the center of gravity or the metacenter and the pivot axis of a split ship in the loaded or empty condition such that the loaded ship can be opened under the influence of the weight of the load and can be closed in the empty condition.

The invention embodies a breakthrough in the general opinion that split ships always have to be constructed out of hull sections formed as symmetrical mirror image counterparts.

The asymmetrical embodiment of the hull sections in agreement with the invention does not entail much change in the fabrication costs and has no or only slight consequences in relation to the discharge of the cargo or load.

According to the invention it is furthermore possible that near the opposed end of said vessel both hull sections are also interconnected in a plane positioned at a distance from said central dividing plane, however at the other side thereof.

In that case it is possible to compensate the unequal volume ratio between both parts of the rear body by an oppositely unequal volume ratio in the forecastle. Thereby the eventual inclination of the ship can be controlled. Furthermore this provides room to position the pump installation in the forecastle part with the largest volume. Besides it is possible to secure the pilot house fixedly to either hull section. The construction can be very simple. If the ship is opened by pivoting both sections over 5° an inclination of the deck of 5° is acceptable especially if one realises that such inclinations are also encountered as a result of the movements of the ship in waves.

The invention will now be explained in more detail with reference to the drawing which illustrates schematically in a top plan view the basic principles on which the invention is based.

The drawing illustrates a vessel comprising the hull sections 1 and 2, pivotably connected together by means of the hinges 3, 4 respectively, of which the hinge shafts 5 are directed in the longitudinal direction of the vessel. The hull sections 1, 2 are furthermore coupled by means of hydraulic cylinders positioned at a lower level underneath each of the hinges 3, 4, which cylinders are known themselves and are not illustrated in the figure and can be installed in the volumes 6, indicated by dash lines. Said cylinders are in a known way used for controlling or if necessary effecting the opening or closing movements.

Each hull section 1, 2 comprises half of the hold, which halves are indicated by 7 and 8 respectively. In the closed condition both halves of the hold are sealingly connected together in a known way whereby the edges of the hull sections, such as the edges 9 and 10 are lie on the vertical central dividing plane of the ship on which also lie the pivot shafts 5.

In the rear body of the ship the division is not along the central division plane, but along a plane 11 and a transverse plane 12, which plane 11 is parallel to the longitudinal axis of the vessel. Said plane might be parallel also to the vertical central dividing plane, however it can also be configured into another shape. If be only necessary that this plane is at such a distance from the vertical central dividing plane that the propulsion installation 13 can be positioned symmetrically in the vessel or at least approximately symmetrically. In the drawing the propulsion installation 13 is positioned in the central dividing plane and is thereby symmetrical positioned in the vessel. The cross section of this part of the rear body of the ship is therefore considerably larger than that of the rear body of the hull section 1. The larger mass of the rear body of the hull section 2 containing the heavy propulsion installation, can make it desirable under certain circumstances to displace the heavier parts of the propulsion installation to the left hand or to the right hand side of the vertical central dividing plane. From a constructive point of view the principles forming the basis of the invention can be embodied in various ways.

It is furthermore possible to divide the forecastle of the ship also asymmetrically, for instance according to the dash lines 14. In that case a vessel is provided of which the rear body at the starboard side and the forecastle body at the port side in the respective hull sections 2, 1 has a larger volume. This is important for the balance in the opened condition and in that case it is possible to install the pumping means in the forecastle part having the larger volume. The pilot house 15 can be fixedly installed on the hull section 2, as is indicated by 15.

I claim:

1. In a vessel comprising two side-by-side hull sections extending lengthwise of the vessel, hinges interconnecting said two hull sections for vertical swinging movement relative to each other about a horizontal axis disposed above the center of gravity of the vessel, said hull sections being adapted to be swung together about said axis to define a hold and swung apart about said axis to empty the contents of the hold, and a propulsion installation carried by said vessel; the improvement in which said hull sections meet along a plane positioned a distance from said axis such that the transverse cross sections of the two hull sections are unequal along an end portion of the length of the vessel, the propulsion installation being housed in the larger hull section of said end portion on one side of said plane.

2. A vessel as claimed in claim 1, said hull sections along a central portion of the length of the vessel meeting along a vertical midplane of the vessel.

3. A vessel as claimed in claim 2, in which said hull sections in the other end portion of the vessel meet along a plane disposed at a distance from said axis but on the other horizontal side of said axis from the first-mentioned plane.

4. A vessel as claimed in claim 1, in which said hull sections in the other end portion of the vessel meet along a plane disposed at a distance from said axis but on the other horizontal side of said axis from the first-mentioned plane.

5. A vessel as claimed in claim 1, and a pilot house fixedly secured to one of said hull sections.

6. A vessel as claimed in claim 1, said propulsion installation including a propeller shaft that lies on the vertical midplane of the vessel.

* * * * *